US007363781B2

(12) United States Patent
Erickson

(10) Patent No.: US 7,363,781 B2
(45) Date of Patent: Apr. 29, 2008

(54) REVERSIBLE DOOR

(75) Inventor: Donald E. Erickson, Newton, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 400 days.

(21) Appl. No.: 11/008,004

(22) Filed: Dec. 9, 2004

(65) Prior Publication Data

US 2006/0123855 A1 Jun. 15, 2006

(51) Int. Cl.
*D06F 17/00* (2006.01)

(52) U.S. Cl. ..... 68/196; 49/382; 49/381

(58) Field of Classification Search ..... 68/196; 49/381, 382

See application file for complete search history.

(56) References Cited

U.S. PATENT DOCUMENTS 2,708,293 A * 5/1955 Sherman ..... 49/382
2,899,717 A 8/1959 Billings
3,321,100 A 5/1967 Toma
5,113,562 A 5/1992 Studt
5,195,647 A 3/1993 Studt
5,253,433 A * 10/1993 Frey ..... 34/603
5,496,104 A 3/1996 Arnold
2003/0172692 A1 9/2003 Hong

FOREIGN PATENT DOCUMENTS

DE 004304086 C1 3/1994
WO WO-0171087 A1 * 2/2001

* cited by examiner

*Primary Examiner*—Michael Barr
*Assistant Examiner*—Jason P. Riggleman
(74) *Attorney, Agent, or Firm*—Michael D. Lafrenz; Clifton Green

(57) ABSTRACT

An improved front loading washing machine is provided with a front panel having a round access opening. A glass door is reversibly mounted on the front panel via a hinge. The hinge can be moved to the left or right side of the access opening by rotating a carriage ring which extends around the access opening and which supports the hinge. A door lock is provided on the carriage opposite the hinge. Accordingly, the door is reversible for opening on the left or right, as desired by a user.

13 Claims, 2 Drawing Sheets

REVERSIBLE DOOR

BACKGROUND OF THE INVENTION

Home installations of laundry appliances often times have the washer and dryer arranged side by side. The arrangement of the washer or dryer on-the left or the right varies from installation to installation. For top loading washing machines, positioning the washer on either the left or the right of the dryer does not create a problem for the washer door. Dryers, which typically are front loading, have been designed to accommodate the left or right position of the washing machine by having a door that can be easily reversed. However, reversal of the door of a front loading washing machine is a problem, due to the door lock which is provided to assure that the door is not opened while the machine is operating, and due to the hinge.

A reversible door with a rectangular access opening is provided on the Maytag Neptune front loading washing machine. On the Neptune machine, the door lock is mounted along the top edge of the door opening, at the center line thereof for locking the rectangular door. It is desirable to have a reversible door on a front loading washing machine with the hinges and door lock on opposite sides of an access opening. However, such reversibility of a door is difficult due to the complexity of the hinge and door lock mechanism.

Accordingly, a primary objective of the present invention is the provision of a reversible door for a front loading washing machine.

Another objective of the present invention is the provision of a reversible glass door for a front loading washing machine which is quickly and easily converted between left and right hand opening.

Still another objective of the present invention is the provision of a reversible door for a front loading washing machine which can be rotated 180° so as to change from a left hand to right hand hinge.

Yet another objective of the present invention is the provision of a front loading washing machine having a glass door which can be reversed between left and right hand orientations without disassembling the washer cabinet.

These and other objectives will become apparent from the following description of the invention.

SUMMARY OF THE INVENTION

A front loading washing machine is provided with a reversible front door which can be rotated 180° so as to pivot open from either the left or right sides. The washing machine includes a front panel with an access opening. A door carriage is mounted on the inside of the front panel, with the door mounted on the outside of the panel. A hinge is supported on the carriage and extends through the front panel so as to pivotally support the door. A door lock is mounted on the carriage so as to lock the door when the machine is in operation. The carriage is a ring which extends around the door opening in the front panel and around the door plug. A cord is attached to the ring to facilitate rotation of the ring 180° such that the left and right hand orientations of the hinge and lock can be reversed. A wire harness for the door lock extends along the carriage so as to be free from interference when the ring is rotated.

DETAILED DESCRIPTION OF THE PREFERRED EMBODIMENT

Figure 3:
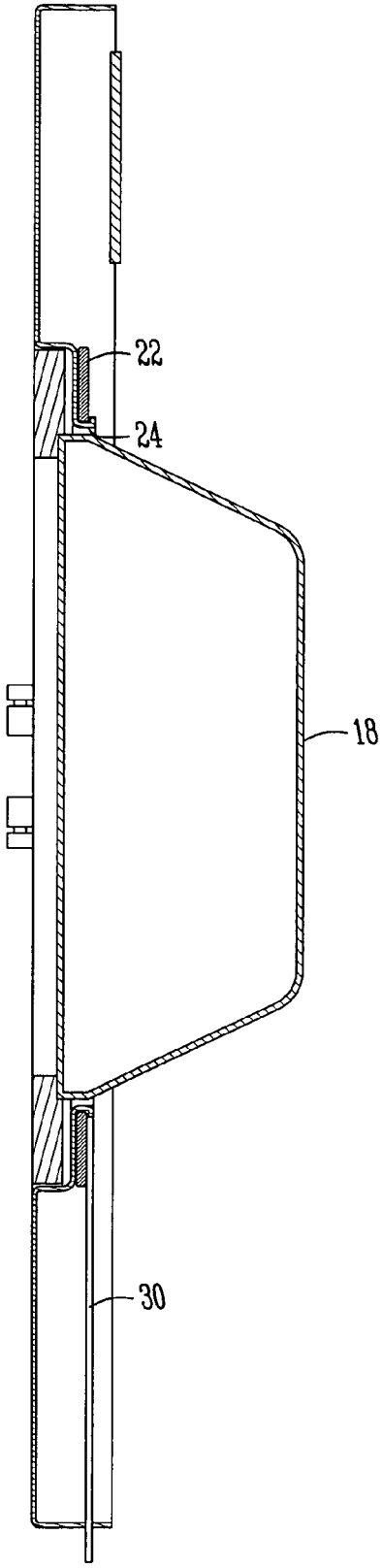
FIG. 3 is a sectional view taken along lines 3-3 of FIG. 1.

A front loading washing machine is generally designated by the reference numeral 10 in the drawings. The washing machine has a cabinet, including a front panel 12, with a control panel 14. A door 16 with a glass window is provided on the front panel 12 and is moveable between open and closed positions relative to an access opening 17 in the front panel. When the door 16 is closed, a water tight seal is provided between the door 16 and the front panel 12. A plug 18 extends rearwardly from the door 16 through the access opening 17, as best seen in FIG. 3.

The door 16 is pivotally supported upon a hinge 20, which is mounted on a carriage 22 using conventional fasteners, such as screws 23. The carriage 22 is a circular ring which extends around access opening 17, and is retained on the inside of the front panel 12 by a flange 24 on the panel 12, as best seen in FIG. 3. The hinge covers one of the holes 25 of the front panel 12.

The carriage 22 also supports a door lock 26, which extends through a hole 27 in the carriage 22. A wire harness 28 extends between the door lock 26 and the control panel 14 for actuation and deactuaction of the lock 26. The wire harness 28 extends along the carriage 22.

The door 16 and carriage 22 are rotatable 180° about the central axis of the access opening 17, such that the door 16 is reversible for left hand or right hand mounting. The hinge 20 must be moved from the carriage 22 before the carriage is rotated. A cord 30 is attached to the top side of the carriage 22 to facilitate the rotation of the carriage within the flange 24 of the front panel 12, without removing the front panel from the remainder of the washing machine cabinet. After the carriage 22 is set in the desired position, the hinge 20 is reattached to the carriage, using any convenient fasteners, such as nuts and bolts, or metal screws. The hole 27 aligns with each of the holes 25 in the front panel 12 in either position of the carriage 22. The door 16 can then be mounted upon the hinge 20, which is located at either the left or right side of the access opening 17.

Preferably, the door plug 18 is symmetrical, such that the plug need not be reversed when the door 16 is reversed. If the plug 18 is not symmetrical, it can be quickly and easily removed from the door 16 via screws, and rotated 180° before the door 16 is mounted on the hinge 20.

Figure 1:
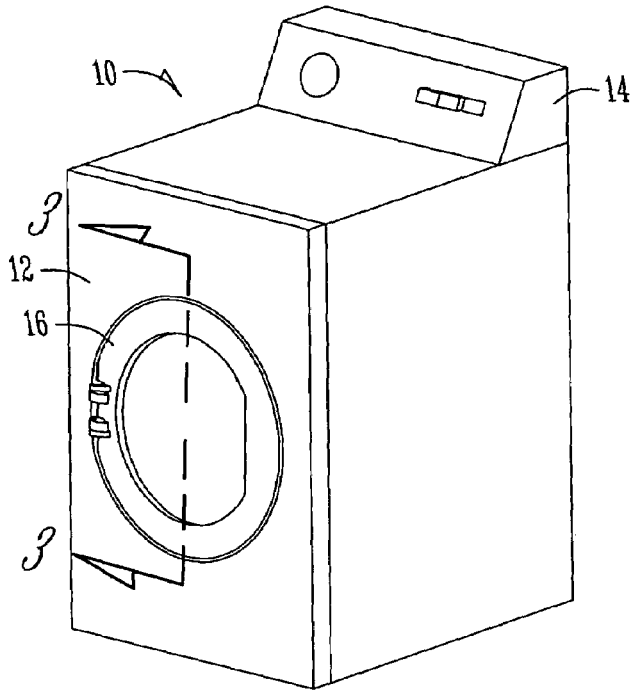
FIG. 1 is a perspective view of a front loading washing machine having the reversible glass door of the present invention.
Figure 2:
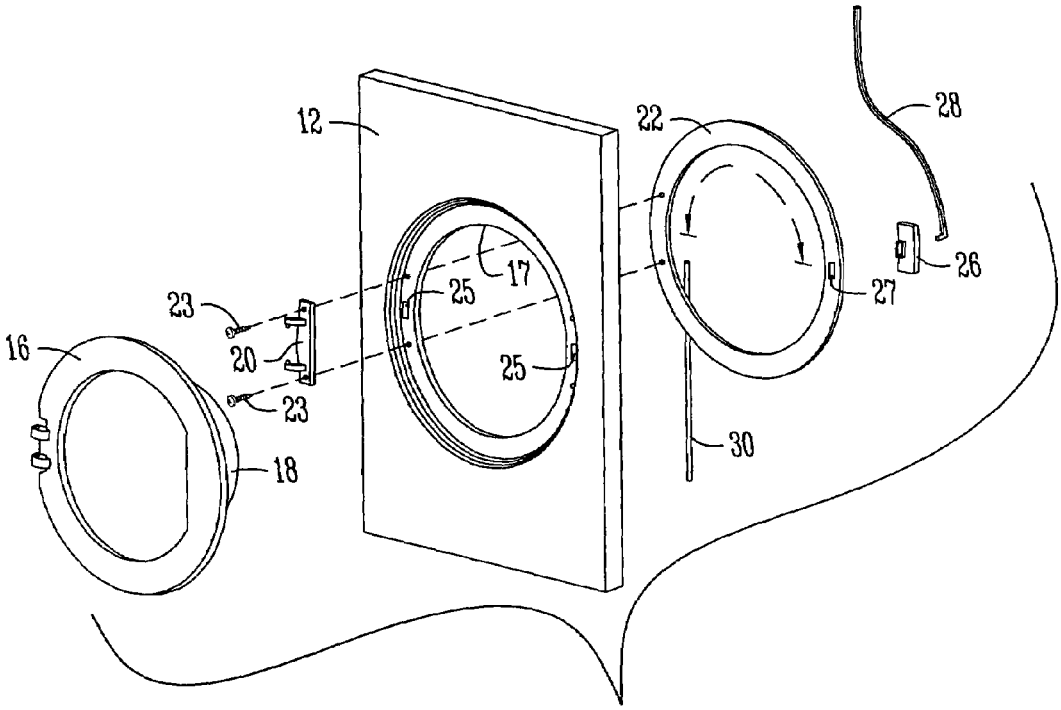
FIG. 2 is an exploded perspective view of the front panel and door of the present invention.

It is understood that the door 16 and access opening 17 do not have to be round, as shown in FIGS. 1 and 2. The carriage 22 is preferably round to facilitate rotation.

As an alternative to the single pivot hinge 20 shown in the drawings, a double pivot hinge may be used. Such a double pivot hinge can be attached directly to the rear of the carriage 22, with the hinge leaves extending through aligned holes in the carriage 22 and the front panel 12. Reversal of the door 16 with a double pivot hinge is accomplished by disconnecting the hinge pin at the door 16, and pushing the hinge leaves back through the holes in the front panel 12 and the carriage 22 so as to allow for rotation of the carriage 22.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A front-loading washing machine having a front panel with an access opening, comprising:

a door carriage mounted on the front panel for rotation about the access opening;

a hinge mounted to the door carriage and to a door for pivotally supporting the door; and the door reversibly mountable on opposite sides of the access opening by rotating the door and the door carriage 180°, and moving the hinge to the opposite side of the access opening.

2. The washing machine of claim 1 further comprising a lock mounted to the door carriage to lock the door in a closed position during operation of the washing machine.

3. The washing machine of claim 2 wherein the carriage is a ring rotatable 180° so as to reverse a left and a right orientation of the hinge and lock.

4. The washing machine of claim 2 wherein the door is in front of the front panel and the carriage is behind the front panel.

5. The washing machine of claim 4 wherein the lock extends through the front panel.

6. The washing machine of claim 2 further comprising a member connected to the carriage to manually rotate the carriage.

7. The washing machine of claim 2 further comprising a wire harness extending along the carriage and connected to the door lock.

8. The washing machine of claim 1 wherein the door includes a window.

9. A front-loading washing machine having a front panel with an access opening, comprising:

a door reversibly mountable in front of the front panel on opposite sides of the access opening by rotating the door 180°;

a door carriage behind the front panel and mounted on the front panel, the door carriage having a hinge to pivotally support the door and a lock extending through the front panel to lock the door in a closed position during operation of the washing machine; and the door is in front of the front panel and the carriage is behind the front panel;

the lock extends through the front panel.

10. The washing machine of claim 9 wherein the carriage is a ring rotatable 180° so as to reverse a left and a right orientation of the hinge and lock.

11. The washing machine of claim 9 further comprising a member connected to the carriage to manually rotate the carriage.

12. The washing machine of claim 9 further comprising a wire harness extending along the carriage and connected to the door lock.

13. The washing machine of claim 9 wherein the door includes a window.

* * * * *